US006279664B1

(12) United States Patent
Yanovsky et al.

(10) Patent No.: US 6,279,664 B1
(45) Date of Patent: Aug. 28, 2001

(54) SIGNALING FIRE EXTINGUISHER SYSTEM

(76) Inventors: Vladislav Yanovsky, 14 Eulita Ter., Brighton, MA (US) 02135; Anatoliy Sirota, 81 Hackensack Rd., West Roxbury, MA (US) 02467

( * ) Notice: Subject to any disclaimer, the term of this patent is extended or adjusted under 35 U.S.C. 154(b) by 0 days.

(21) Appl. No.: 09/541,559

(22) Filed: Apr. 3, 2000

(51) Int. Cl.[7] ..... A62C 11/00; A62C 13/76
(52) U.S. Cl. ..... 169/75; 169/30
(58) Field of Search ..... 169/30, 75, 76, 169/88; 73/705, 741, 743; 239/71

(56) References Cited

U.S. PATENT DOCUMENTS 3,286,529 * 11/1966 Damrel, Jr. et al. ..... 73/418
3,777,569 * 12/1973 Krulee ..... 73/389
3,815,421 * 6/1974 Harland et al. ..... 73/418
3,915,009 * 10/1975 Worden et al. ..... 73/398 R
4,279,161 * 7/1981 Huston et al. ..... 73/743
5,775,430 * 7/1998 McSheffrey ..... 169/30

* cited by examiner

*Primary Examiner*—David A. Scherbel
*Assistant Examiner*—Davis Hwu
(74) *Attorney, Agent, or Firm*—William Nitkin

(57) ABSTRACT

A portable fire extinguisher of the type utilizing a rotating Bourdon coiled tubing valve gauge having a reflective portion and a non-reflective portion with a beam transmitted at a portion of such coiled tubing such that when the gauge has rotated to indicate that the pressure in the fire extinguisher tank has dropped below a predetermined level, there is a corresponding change in the reflective state of the coiled tubing which changes the reflection of the beam, such change in reflection being sensed and processed. The resultant signal can be directed through telephone lines to a remote location where such fire extinguisher's condition is identified for servicing.

10 Claims, 2 Drawing Sheets

FIG. 2
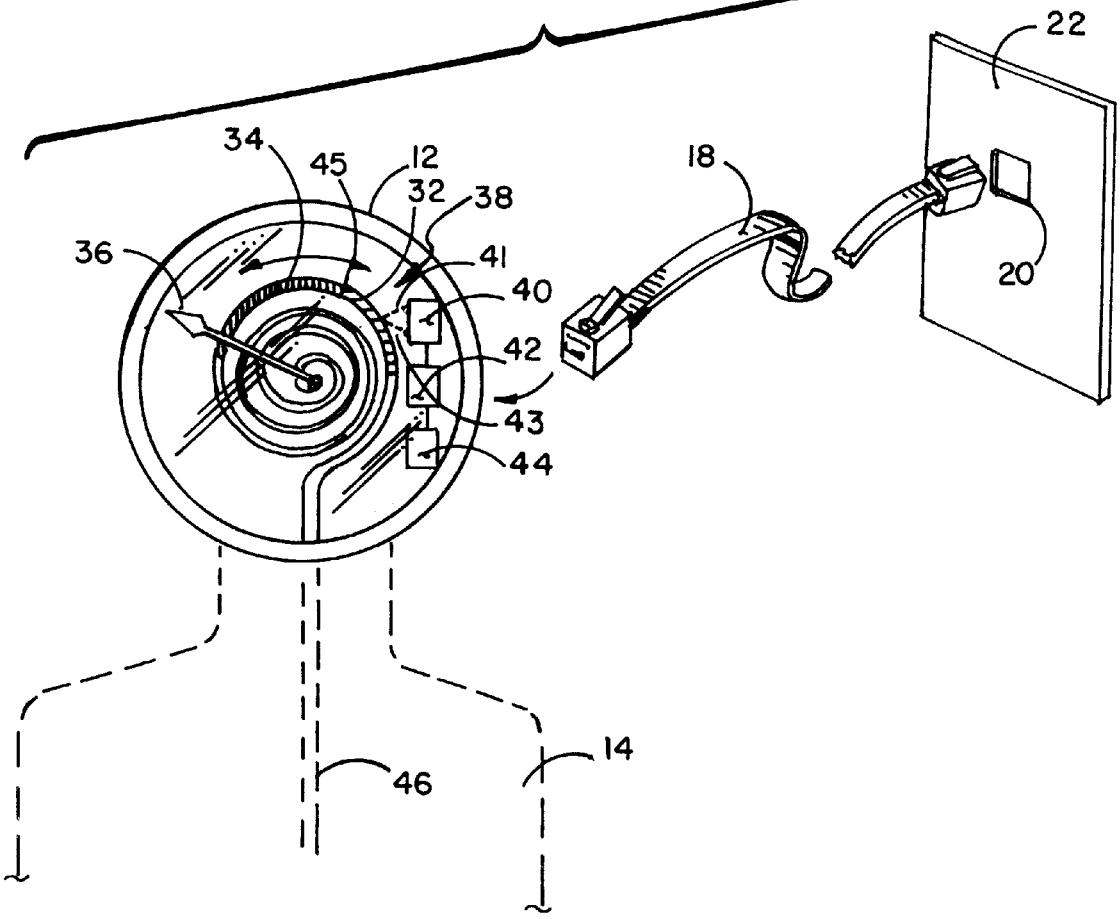
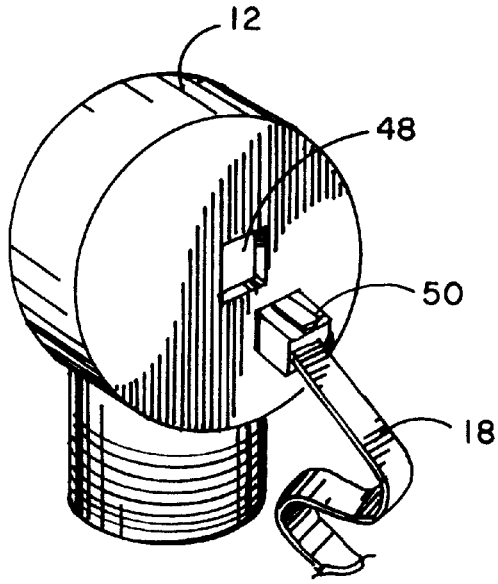
FIG. 3

SIGNALING FIRE EXTINGUISHER SYSTEM

BACKGROUND OF THE INVENTION

1. Field of the Invention

The system of this invention resides in the field of portable fire extinguishers and more particularly relates to a portable fire extinguisher having a tank with fire-extinguishing contents under pressure, a handle release, a nozzle, a pressure gauge to indicate the pressure status within the tank and a signaling device to signal over a telephone line when such pressure drops below a predetermined pressure level.

2. History of the Prior Art

Signaling fire extinguishers are known in the prior art, such as those described in U.S. Pat. Nos. 5,775,430 and 5,848,651. In these patents the valve gauge pointer, when signifying a low-pressure level within the tank of the fire extinguisher, comes in contact with an electrical contact to complete an electrical circuit powered by an internal battery to cause the fire extinguisher to emit an audio or visual signal and to transmit a signal via wireless radio frequency communication to a central location so that those at the central location will become aware that such fire extinguisher needs servicing.

SUMMARY OF THE INVENTION

It is an object of this invention to provide a signaling fire extinguisher that requires no internal battery power supply and does not rely on wireless communication to transmit data in order to avoid the problem of power supply failure over the life of the battery used in prior art devices.

It is a further object of this invention that the signaling device of this invention be able to be incorporated into existing pressure gauge designs of portable fire extinguishers with minimal difficulty and expense.

The device of this invention is designed to send a signal from a fire extinguisher through a telephone line to report to a receiving computer at a remote location or even via the Internet to a computer which identifies the fire extinguisher and its location so that service can be promptly provided upon such fire extinguisher's tank reaching an undesirable low pressure status. The use of a telephone "land line" to carry a signal has an advantage over the prior art's use of wireless radio transmission in that telephone lines are affected much less by outside electronic noise or static that disrupts radio transmissions and which static could result in erroneous gauge readings from fire extinguishers of the prior art.

It is a still further object of this invention to provide a more economical fire extinguisher by avoiding the need for expensive radio frequency transmitters of limited range and internal power supplies of limited life found in the prior art.

A further goal of this invention is to provide means to detect a low pressure in the tank of a portable fire extinguisher which does not rely on electrical connections being made between its circuitry and the valve gauge needle as the present invention operates utilizing a beam transmitter/receiver.

The device of this invention is designed to operate with a fire extinguisher having fire-extinguishing contents under pressure in a tank and having a pressure gauge that utilizes a Bourdon coiled tubing gauge, the coiling of which moves the gauge pointer as the pressure in the tank decreases. The invention herein relies on the movement of the Bourdon coiled tubing. A portion of the tubing is painted black so as not to be light-reflective. Another portion of the tubing is unpainted as it is naturally reflective or can be painted with a reflective paint. A beam transmitter/receiver, such as an infrared beam transmitter/receiver is positioned within the pressure gauge such that its beam is transmitted to a point on the tubing. In one embodiment when the non-reflective portion of the tubing is in front of the beam, it is not reflected back to the beam transmitter/receiver. As the tubing slowly rotates as the pressure in the tank decreases and comes to a point where the pressure within the tank is low, the non-reflective paint ends and the reflective portion of the tube is then exposed to the transmitted beam which is then reflected back to a receiver which can be within the same chip. Upon sensing such beam signal, the beam transmitter/receiver sends an analog signal to a computer chip which, in turn, directs a signal to a converter chip described below which is engaged through a jack to a telephone line wherein such converter chip calls to a central computer either directly or via the Internet and identifies the fire extinguisher having low pressure in its tank and its location so that it can be attended to and either replaced or its pressure recharged. The computer chip and converter circuitry can be incorporated on the same board as the beam transmitter/receiver, or they can be located on the exterior of the pressure gauge. Power is supplied to this invention from the current supplied through the telephone line. In some embodiments the central computer can be located on the same line as that of the fire extinguisher so that transmission of a signal over telephone lines or the Internet would be unnecessary. The advantage of the present invention not requiring an internal battery is significant as batteries wear down and require regular checking and replacement whereas in the present invention the power supply for communication is supplied by existing telephone wiring, thus providing an unlimited duty cycle.

BRIEF DESCRIPTION OF THE DRAWINGS

FIG. 2 illustrates a perspective view of the front of a pressure gauge with the scale covering removed exposing the Bourdon coiled tubing and indicating its interconnection to a telephone jack.

FIG. 3 illustrates a rear perspective view of the pressure gauge of FIG. 2, indicating the telephone line interconnection.

DESCRIPTION OF THE PREFERRED EMBODIMENT(S)

Figure 1:
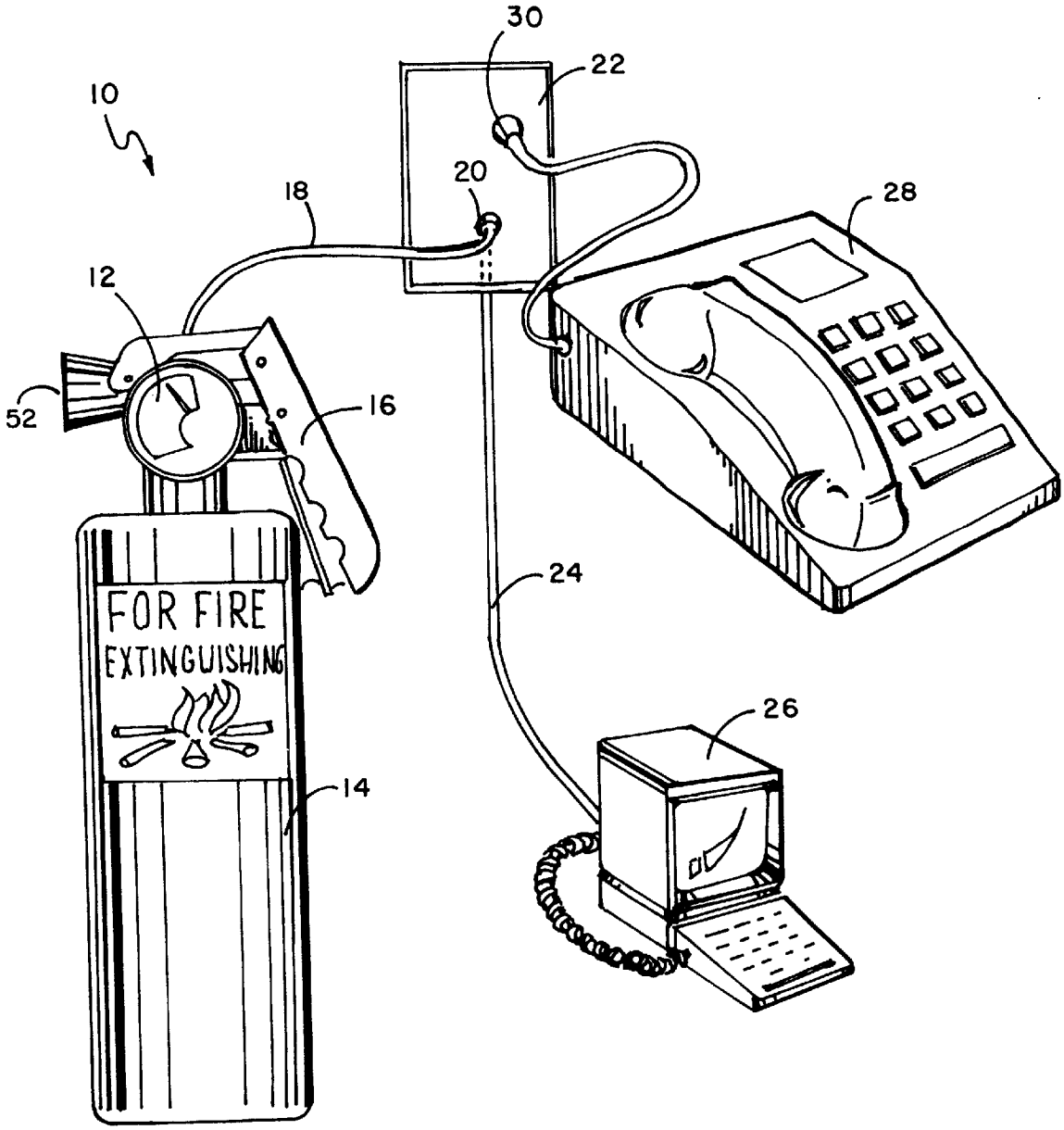
FIG. 1 illustrates a perspective view of a system utilizing the Signaling Fire Extinguisher of this invention.

FIG. 1 illustrates a perspective view of a system of this invention showing portable fire extinguisher 10 having pressure gauge 12 mounted atop tank 14. Trigger mechanism 16 is seen which, upon squeezing, releases the contents of tank 14 out nozzle 52. Pressure gauge 12 is interconnected by telephone line 18 to telephone wall junction 22 into extinguisher line receipt jack 20. Telephone 28 is also shown interconnected through telephone jack 30. Telephone jack 30 is interconnected through its wiring, a portion of which is figuratively depicted as telephone line 24 running to computer 26.

FIG. 2 illustrates an enlarged front view of a portion of the fire extinguisher with the face plate of pressure gauge 12 not shown and with the trigger and nozzle mechanisms also not depicted. Seen in this view is Bourdon coiled tubing 38, a portion of which has a darkened, non-reflective coating 34 and the remainder of which is a reflective portion 32. In one embodiment as long as the darkened, non-reflective portion 34 is exposed to infrared beam 41 emanating from beam transmitter/receiver 40, no beam is reflected back to receiver 43 of beam transmitter/receiver 40. Transmitter/receiver 40 can be an infrared transmitter/receiver, a laser transmitter/receiver or an equivalent beam transmitter/receiver. When the pressure drops in tank 14, as sensed through pressure line 46, the Bourdon coiled tubing 38 rotates, moving reflective portion 32 toward beam 41 until ultimately exposing reflective portion 32 to beam 41, as seen in FIG. 2, which beam 41 is then, in turn, reflected back and sensed by receiver 43. Beam transmitter/receiver 40 can be a Motorola Max 485 or equivalent. The signal received by beam transmitter/receiver 40 in one embodiment can be directed to computer processor 42 which controls the beam's output signal's intensity and frequency and converts the received signal from an analog signal to a digital signal. Such signal is then directed to a data synchronizer/computer interface 44 which, in turn, directs the signal to telephone line 18 which directly communicates with a computer at a central processing station by communicating over a telephone land line or going online on the Internet to reach central computer 26 to indicate to it the low pressure status of the fire extinguisher and its location. The use of such telephone land lines reduces or eliminates static or other extraneous electrical noise that interferes with radio transmissions of the prior art. Computer processor 42 can be a Motorola PIC 120 or equivalent.

It should be noted that the infrared beam could be directed either first against a reflective or a non-reflective portion of Bourdon coiled tubing 38 as it is the change in reading between adequate pressure and low pressure denoted by the demarcation line 45 between the reflective and non-reflective portions of tubing 38 that causes the activation of the system of this invention. In some embodiments the reflective portion of the Bourdon coiled tubing could be used to designate the condition of adequate pressure within the fire extinguisher tank while in other embodiments it could be the non-reflective portion. When a change in the reflection of the beam is detected by the beam transmitter/receiver 40, such signal is interpreted within computer processor 42 where the output signal intensity and frequency is controlled as well as the determination of the frequency and intensity of the returned beam. When computer processor 42 denotes a change between the reflective and non-reflective surface of tubing 38 indicating that the fire extinguisher's pressure has decreased below a predetermined pressure level, it sends that signal to data synchronizer/computer interface 44 where the signal is synchronized and transmitted to a computer over standard telephone lines. Computer processor 42 converts the received beam's signal pulse from an analog signal to a digital signal which it then compares to its beam signal output and if a change in state is detected, it directs a signal to the data synchronizer/computer interface 44. Computer processor 42 allows for the modification of the infrared signal intensity and frequency by the use of different computer software which are specifically designed to function with computer processor 42. This feature is helpful in order to adjust and accommodate for various external conditions such as ambient lighting. Once the analog beam signal is received, the computer processor converts it to a digital format for further interpretation and computer processing. In order to prevent and eliminate external interference affecting the reflected beam's signal, the computer processor can direct the transmitter to emit one beam pulse signal but to receive two signals for every beam pulse signal emitted. This feature allows for comparison of the two received signals, one being the returning transmitted beam signal and the other being a reading of the ambient natural light level. Computer processor 42 can then subtract the natural ambient light level from the returned transmitted beam return signal and then process the resultant "difference" signal in order to eliminate the possibility of external ambient light interference.

FIG. 3 illustrates a rear view of pressure gauge 12 showing a telephone receipt socket 48 to receive telephone jack 50 at the end of telephone line 18. Socket 40 and jack 50 can be of a type providing a hermetic seal with hermetically sealed gauge 12.

Although the present invention has been described with reference to particular embodiments, it will be apparent to those skilled in the art that variations and modifications can be substituted therefor without departing from the principles and spirit of the invention.

We claim:

1. A portable fire extinguisher, comprising:

a pressure gauge;

a tank having fire-extinguishing contents under pressure, said tank in communication with said pressure gauge;

a Bourdon coiled tubing disposed within said pressure gauge, said Bourdon coiled tubing movable by a change in pressure within said tank, said Bourdon coiled tubing having a non-reflective portion and a reflective portion;

a beam transmitter/receiver positioned at said pressure gauge for producing a transmittable beam directed upon said Bourdon coiled tubing at a point where said non-reflective portion of said Bourdon coiled tubing is positioned in front of said beam when said tank is adequately pressurized thereby not reflecting said beam to said transmitter/receiver, and when said Bourdon coiled tubing rotates to a position caused by low pressure within said tank, said reflective portion of said Bourdon coiled tubing is then positioned in front of said beam, reflecting said beam back to said beam transmitter/receiver;

means for sensing a change in said beam's reflection when said tank reaches a state of low pressure and for producing a signal to indicate said state of low pressure; and means for directing said produced signal over a line to a remote location to indicate a low-pressure situation in said tank.

2. A portable fire extinguisher, comprising:

a pressure gauge;

a tank having fire-extinguishing contents under pressure, said tank in communication with said pressure gauge;

a Bourdon coiled tubing disposed within said pressure gauge, said Bourdon coiled tubing movable by a change in pressure within said tank, said Bourdon coiled tubing having a non-reflective portion and a reflective portion;

a beam transmitter/receiver positioned at said pressure gauge for producing a transmittable beam directed upon said Bourdon coiled tubing at a point where said reflective portion of said Bourdon coiled tubing is positioned in front of said beam when said tank is adequately pressurized, reflecting said beam back to said beam transmitter/receiver and when said Bourdon coiled tubing rotates to a position caused by low pressure within said tank, said non-reflective portion of said Bourdon coiled tubing is then positioned in front of said beam and said beam is then not reflected back to said transmitter/receiver;

means for sensing a change in said beam's reflection when said tank reaches a state of low pressure and for producing a signal to indicate said state of low pressure; and means for directing said produced signal over a line to a remote location to indicate a low-pressure situation in said tank.

3. A portable fire extinguisher, comprising:

a pressure gauge;

a tank having fire-extinguishing contents under pressure, said tank in communication with said pressure gauge;

a Bourdon coiled tubing disposed within said pressure gauge, said Bourdon coiled tubing movable by a change in pressure within said tank, said Bourdon coiled tubing having a non-reflective portion and a reflective portion;

a beam transmitter/receiver positioned at said pressure gauge for producing a transmittable beam directed upon said Bourdon coiled tubing at a point where said non-reflective portion of said Bourdon coiled tubing is positioned in front of said beam when said tank is adequately pressurized, thereby not reflecting said beam to said transmitter/receiver and when said Bourdon coiled tubing rotates to a position caused by low pressure within said tank, said reflective portion of said Bourdon coiled tubing is then positioned in front of said beam, reflecting said beam back to said beam transmitter/receiver;

means for sensing a change in said beam's reflection when said tank reaches a state of low pressure and for producing a signal to indicate said state of low pressure;

means for directing said produced signal over a line to a remote location to indicate a low-pressure situation in said tank; and wherein said means for sensing the change in said beam's transmission is a computer processor converting the received beam's analog signal to a digital signal, and said means for directing said signal over a line is a data synchronizer/computer interface which receives said digital signal and directs it over a telephone line to a central computer for identifying a fire extinguisher having low pressure in its tank.

4. The fire extinguisher of claim 2 wherein said means for sensing the change in said beam's transmission is a computer processor converting the received beam's analog signal to a digital signal, and said means for directing said signal over a line is a data synchronizer/computer interface which receives said digital signal and directs it over a telephone line to a central computer for identifying a fire extinguisher having low pressure in its tank.

5. The fire extinguisher of claim 3 further including means for eliminating the effect of ambient light on said beam transmitter/receiver.

6. The fire extinguisher of claim 4 further including means for eliminating the effect of ambient light on said beam transmitter/receiver.

7. The fire extinguisher of claim 5 wherein said means for eliminating the effect of ambient light on said beam transmitter/receiver includes said beam transmitter/receiver transmitting one beam signal but receiving two signals for every one transmitted beam signal and subtracting the second received signal representing the ambient light from said received transmitted beam signal.

8. The fire extinguisher of claim 6 wherein said means for eliminating the effect of ambient light on said beam transmitter/receiver includes said beam transmitter/receiver transmitting one beam signal but receiving two signals for every one transmitted beam signal and subtracting the second received signal representing the ambient light from said received transmitted beam signal.

9. A method of determining a low-pressure status within the tank of a portable fire extinguisher of the type utilizing a Bourdon coiled tubing pressure gauge, comprising the steps of:

providing a reflective portion and a non-reflective portion on said Bourdon coiled tubing;

transmitting a beam at said Bourdon coiled tubing;

sensing the reflection of said beam when said Bourdon coiled tubing has rotated to a point indicating low pressure in said tank;

converting said received signal to a digital signal; and transmitting said digital signal over a telephone line to a central computer to indicate the identity of the fire extinguisher having low pressure in its tank.

10. A method of determining a low-pressure status within the tank of a portable fire extinguisher of the type utilizing a Bourdon coiled tubing pressure gauge, comprising the steps of:

providing a reflective portion and a non-reflective portion on said Bourdon coiled tubing;

transmitting a beam at said Bourdon coiled tubing;

sensing the cessation of reflection of said beam when said Bourdon coiled tubing has rotated to a point indicating low pressure in said tank;

converting said signal of reflection cessation to a digital signal; and transmitting said digital signal over a telephone line to a central computer to indicate the identity of the fire extinguisher having low pressure in its tank.

* * * * *